United States Patent [19]

Hodgson et al.

[11] 4,129,311

[45] Dec. 12, 1978

[54] ILLUMINATED SKI POLE

[75] Inventors: David A. Hodgson, Hamburg; James S. Grey, East Otto, both of N.Y.

[73] Assignee: International Power Pole, Ltd., Hamburg, N.Y.

[21] Appl. No.: 758,071

[22] Filed: Jan. 10, 1977

[51] Int. Cl.[2] ..... A63C 11/22

[52] U.S. Cl. ..... 280/11.37 E; 362/34; 362/102

[58] Field of Search ..... 280/11.37 H, 11.37 B, 280/11.37 D, 11.37 E; 135/66; 240/6.42, 2.25; 362/34, 102

[56] References Cited

U.S. PATENT DOCUMENTS

| | | | |
|---|---|---|---|
| 2,245,349 | 6/1941 | Lombardi | 135/66 X |
| 2,435,650 | 2/1948 | Greene | 240/6.42 |
| 3,539,796 | 11/1970 | Zychal | 240/2.25 X |
| 3,576,987 | 5/1971 | Voight et al. | 240/2.25 |
| 3,597,362 | 8/1971 | Bollyky et al. | 260/485 H X |
| 3,884,560 | 5/1975 | Neylan et al. | 240/2.25 X |
| 4,023,817 | 5/1977 | Lah et al. | 280/11.37 B |

FOREIGN PATENT DOCUMENTS

| | | | |
|---|---|---|---|
| 642554 | 7/1962 | Italy | 280/11.37 H |
| 284076 | 1/1928 | United Kingdom | 135/66 |

*Primary Examiner*—Joseph F. Peters, Jr.
*Assistant Examiner*—Milton L. Smith
*Attorney, Agent, or Firm*—Christel & Bean

[57] ABSTRACT

A ski pole has a tubular body member having an upper end portion of enlarged diameter to provide handle means and a removable cap at its upper end. A cylindrical chemiluminescent member having an enlarged head portion is disposed in said body member with its head portion seating against an internal ledge at the lower end of the handle means. An opening in the wall of said tubular body member emits light from the chemiluminescent member. In a further embodiment a dry cell battery is disposed in the upper end of the body member and includes a pair of probes connected to the battery terminals and adapted to be projected downwardly through the upper end of the chemiluminescent member to re-energize the same.

4 Claims, 3 Drawing Figures

ILLUMINATED SKI POLE

BACKGROUND OF THE INVENTION

This invention relates to ski poles and, more particularly, to illuminating means contained within a tubular portion of the ski pole for emitting light radially outwardly therefrom.

Night skiing is commonly practiced and ski runs are illuminated to facilitate night skiing. However, such illumination is limited in range and skiers often depart from the ski run proper, either deliberately or accidentally, and under such conditions an illuminated ski pole is of substantial usefulness.

Skiers who depart from the normal ski run may be in trouble and, under these conditions, the illuminated ski pole is of great assistance in locating the errant skier in the event that he needs assistance. The skier may wave the illuminated ski pole to attract attention. Also, the illumination normally provided by the ski run operator is subject to power failure, in which case the illuminated ski pole is useful even on the normal ski run.

SUMMARY OF THE INVENTION

The present invention provides an illuminating source disposed within the upper end of a tubular ski pole body with an appropriate opening in the wall of the body whereby light from the illuminating element radiates outwardly.

In the present invention the illuminating device comprises a chemiluminescent element which is of generally cylindrical elongated form and has an enlarged head portion at one end thereof. The ski pole has a handle portion of enlarged diameter at its upper end which provides an internal ledge at the juncture of the handle portion with the ski pole body proper.

The illuminating element is disposed in the upper end of the tubular ski pole with the enlarged end portion thereof seating downwardly against this internal ledge within the ski pole. A removable cap closes the upper end of the ski pole and a compression coil spring may be provided which acts between the underside of the cap and the upper end of the illuminating member to retain the latter seated against the ledge in the ski pole body.

In a modification of the foregoing basic structure a dry cell battery is disposed above the illuminating element and has a pair of probes projecting downwardly from its terminals to pierce the upper end of the illuminating element to re-energize the same when its normal period of chemiluminescence ceases.

DESCRIPTION OF THE ILLUSTRATED EMBODIMENT

Figure 1:
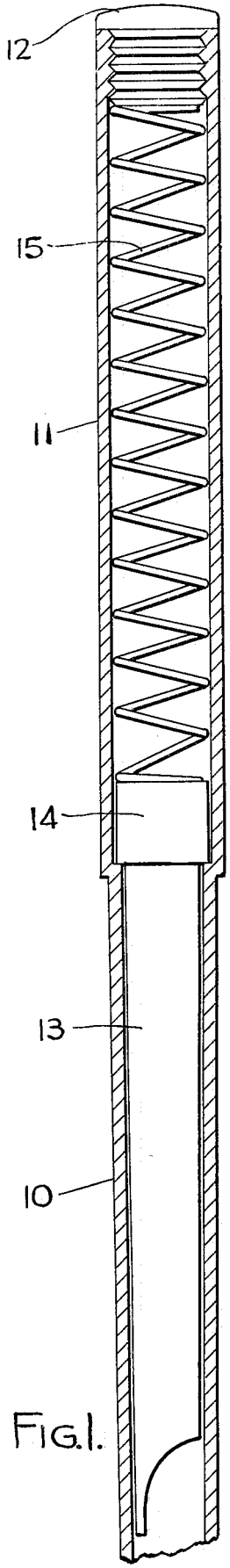
FIG. 1 is a longitudinal cross-sectional view of the upper portion of a ski pole which incorporates the illuminating arrangement of the present invention.

In the drawing the numeral 10 designates the upper portion of a tubular ski pole and an enlargement 11 thereof serves as a handle portion. The upper end of the ski pole is closed by a screw plug 12. The present illuminating means comprises what is known in the art as a lightstick. Such lightsticks are chemiluminescent devices of a type shown in U.S. Pat. Nos. 3,576,987 and No. 3,597,362 and are sold by American Cyanimid Company under the name Cyalume.

The Cyalume devices referred to above comprise elongate cylindrical plastic cartridges which are somewhat flexible and contain a breakable ampule or capsule which contains chemical material. By flexing the cylindrical cartridge the ampule is broken and sets up a chemical reaction which illuminates the cartridge for several hours. The lightstick shown herein by way of example is designated 13, has an enlarged cylindrical head portion 14.

As shown in FIG. 1 the lightstick 13 fits snugly within the upper end of the ski pole and the enlargement 14 thereof seats against the internal ledge at the juncture of the handle portion 11 with the ski pole proper. A compression coil spring 15 is disposed between the lower face of screw plug 12 and the upper end of lightstick 13 to retain the latter against upward movement.

Figure 2:
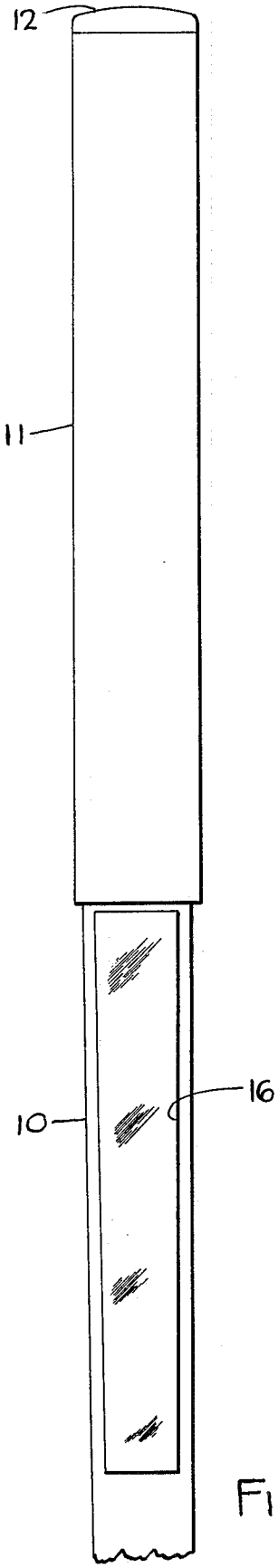
FIG. 2 is an elevational view of the structure of FIG. 1 viewed in the same direction.

As shown in FIG. 2 an opening 16 in ski pole 10 emits light from the lightstick 13 and a lens member which forms a smooth continuation of the surface of the ski pole is preferably fitted into the opening 16.

Figure 3:
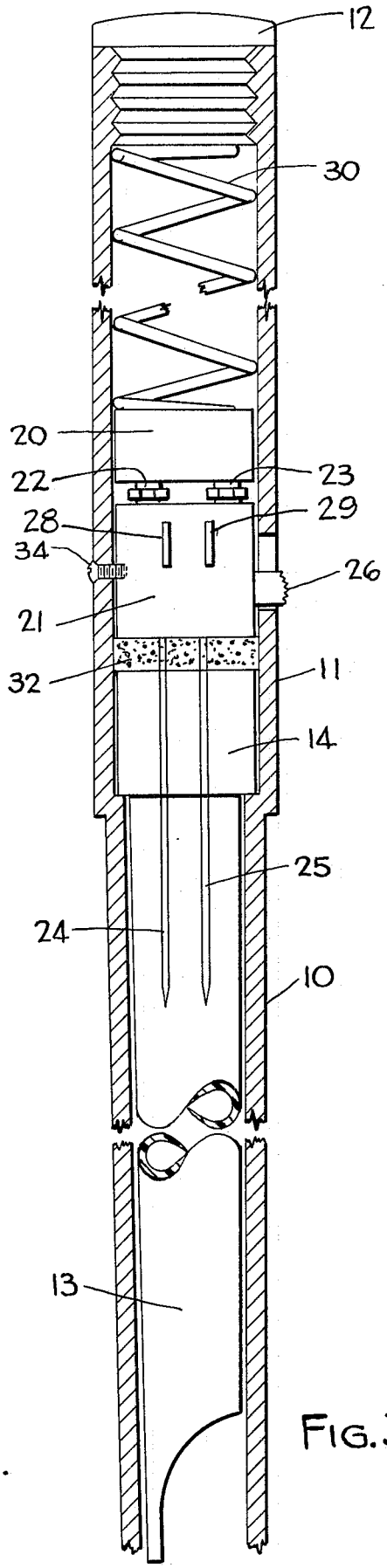
FIG. 3 is a longitudinal cross-sectional view of the upper portion of the ski-pole of FIG. 1 showing auxiliary means for extending the useful life of the illuminating means.

In the embodiment of FIG. 3 the ski pole 10 and lightstick 13 are the same as in the embodiment of FIGS. 1 and 2. FIG. 3 illustrates an arrangement whereby the useful life of the lightstick may be indefinitely extended by applying low voltage electrical energy to the interior thereof. In FIG. 3 the numeral 20 designates a dry cell battery which is connected to a switch element 21 by snap fasteners 22 and 23 and a pair of probes 24 and 25 extend downwardly from the lower end of switch element 21.

In FIG. 3 the operating push button 26 of switch element 21 is in the ON position and accordingly the probes 24 and 25 are connected to the terminals of battery 20 which causes the lightstick to remain illuminated even though its initial spontaneous chemiluminescense is exhausted. To obtain this result the probes 24 and 25 are projected downwardly to pierce the upper wall of lightstick 13 and project into the interior thereof.

When the operating button 26 is moved upwardly from the position shown in FIG. 3 the connection between battery 20 and probes 24 and 25 is broken and at such time, if desired, the battery 20 may be recharged by plugging into outlet openings 28 and 29 of switch 21 a plug connected with a source of direct current. As in the previous embodiment, a compression coil spring 30 is employed to press downwardly against the upper surface of battery 20 to retain the battery 20, the switch 21, and the lightstick 13 in securely assembled relationship.

A sealing disc 32 of rubber or the like is preferably interposed between the upper end wall of the lightstick and the lower surface of switch 21 to prevent leakage of fluid from lightstick 13 through the openings therein made by the probes 24 and 25. A setscrew 34 may be employed for retaining switch element 21 in proper assembled position in the ski pole.

Preferred embodiments of this invention having been hereinabove described and illustrated in the drawings, it is to be understood that numerous modifications thereof can be made without departing from the broad spirit and scope of this invention as defined in the appended claims.

We claim:

1. An illuminated ski pole comprising a pole body having a tubular upper portion, a removable cap at the upper end of said tubular portion, an elongate cylindrical chemiluminescent member inserted in said tubular upper portion, and an opening in the wall of said upper portion of the ski pole in registry with said chemiluminescent member whereby light from said member is emitted radially outwardly of said ski pole, a dry cell battery overlying said chemiluminescent member and probe elements projecting from the terminals thereof downwardly through the upper end of said chemiluminescent member to energize the latter.

2. An illuminated ski pole according to claim 1 including switch means interposed between said dry cell battery and said probe elements and having an operating member projecting radially outwardly through the wall of said ski pole.

3. An illuminated ski pole comprising a pole body having a tubular upper portion, a removable cap at the upper end of said tubular portion, an elongate cylindrical chemiluminescent member inserted in said tubular upper portion, and an opening in the wall of said upper portion of the ski pole in registry with said chemiluminescent member whereby light from said member is emitted radially outwardly of said ski pole, the upper end of said ski pole tubular upper portion being of enlarged diameter to provide handle means and an internal ledge at the lower end of said enlarged diameter portion, said chemiluminescent member having a body portion and an enlarged end portion adapted to seat on said ledge whereby the body portion thereof extends downwardly in said ski pole below said handle means, said wall opening being disposed below said handle means, said ski pole having a dry cell battery overlying siad chemiluminescent member and probe elements projecting from the terminals thereof downwardly through the upper end of said chemiluminescent member to energize the latter.

4. An illuminated ski pole according to claim 3 including switch means between said dry cell battery and said probe elements and having an operating member projecting outwardly through the wall of said handle means.

* * * * *